US006415915B1

(12) United States Patent
Grossman

(10) Patent No.: US 6,415,915 B1
(45) Date of Patent: Jul. 9, 2002

(54) EYEGLASS CASE STAND

(76) Inventor: Morris Grossman, 5824 Forbes Ave., Pittsburgh, PA (US) 15217

( * ) Notice: Subject to any disclaimer, the term of this patent is extended or adjusted under 35 U.S.C. 154(b) by 0 days.

(21) Appl. No.: 09/862,771

(22) Filed: May 21, 2001

(51) Int. Cl.[7] ..... A45C 11/04
(52) U.S. Cl. ..... 206/6; 206/45.23; 220/4.22
(58) Field of Search ..... 206/5, 6, 45.2, 206/45.23, 736, 751; 220/4.21, 4.22, 4.24, 826

(56) References Cited

U.S. PATENT DOCUMENTS 2,670,842 A * 3/1954 Kruft ..... 220/826
3,784,046 A * 1/1974 Cata ..... 220/826
5,467,869 A * 11/1995 Elie et al. ..... 206/6
5,493,349 A * 2/1996 Barhydt et al. ..... 206/6
5,615,765 A * 4/1997 Roericht ..... 206/6
6,039,174 A * 3/2000 Rogers ..... 206/6

* cited by examiner

*Primary Examiner*—Luan K. Bui
(74) *Attorney, Agent, or Firm*—Cohen & Grisby, P.C.

(57) ABSTRACT

The present invention relates to a storage device that functions as both an eyeglass case and an eyeglass holder. It comprises a first container member and second container member that are pivotably joined together to form a housing in a closed position or a pair of open housings when pivoted to an open position.

10 Claims, 6 Drawing Sheets

EYEGLASS CASE STAND

FIELD OF THE INVENTION

This invention relates to an eyeglass storage device and, in particular, to an eyeglass storage device that is convertible into an eyeglass case or a stand for holding a pair of eyeglasses.

BACKGROUND OF THE INVENTION

Typically, eyeglass wearers store their eyeglasses in an eyeglass case when not in use, such as overnight or for convenient travel. Eyeglass stands are also used by wearers and commercially available as an alternative means of storing eyeglasses that allows ease in locating to and accessing eyeglasses. Wearers who enjoy both storage options are burdened with the expense and maintenance of both devices.

Accordingly, it is an object of the present invention to provide a storage device that functions as both an eyeglass case and an eyeglass holder. The present invention facilitates the use and transport of eyeglass cases and holders by offering an easy to use device superior to traditional devices. Additionally, it saves eyeglass wearers the expense of purchasing separate devices to meet both needs and lessens the burden of keeping track of more than one eyeglass storage device. The invention is especially practical for travel when a wearer's baggage space is limited.

SUMMARY OF THE INVENTION

The present invention relates to a storage device that functions as both an eyeglass case and an eyeglass holder. It comprises a first container member and second container member that are pivotably joined together to form a housing in a closed position or a pair of open housings when pivoted to an open position. The housing is generally defined to accommodate a pair of eyeglasses for storing or holding them.

At least one of the container members has a pivotable wall or lid. By adjusting this pivotable wall, the container member interchanges from a closed to an open position. Thus, when the invention is set as an eyeglass case, pivoting the pivotable wall or lid opens part of the eyeglass case and eyeglasses may be inserted or removed through this opening. The pivotable wall may overlap an edge or perimeter of the exterior side of the other container member.

When the pivotable wall is adjusted to place the container member into an open position, first and second container members can be pivoted at their joinder to provide two open housings. Either or both of the open housings are suited to hold a pair of eyeglasses. When the storage device is in the closed position it functions as an eyeglass case; when in the open position it functions as an eyeglass holder or stand. In this way, the invention switches between being an eyeglass case and an eyeglass holder.

A primary object of the present invention is to provide a storage device that functions as both an eyeglass case and an eyeglass holder and is relatively easy to manipulate for purposes of converting from one to the other. Other advantages of the present invention will become apparent from a perusal of the following detailed description of a presently preferred embodiments taken in connection with the accompanying drawings.

DETAILED DESCRIPTION OF THE INVENTION

Figure 1:
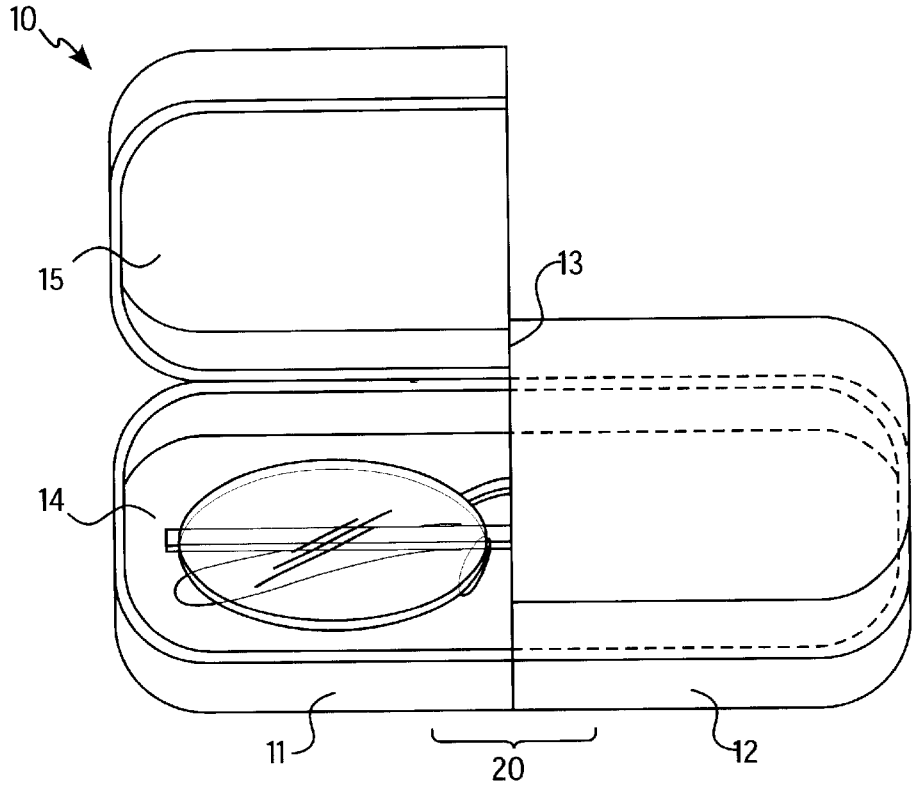
FIG. 1 is a perspective view of the present invention in an eyeglass case storage position that is partially open.
Figure 2:
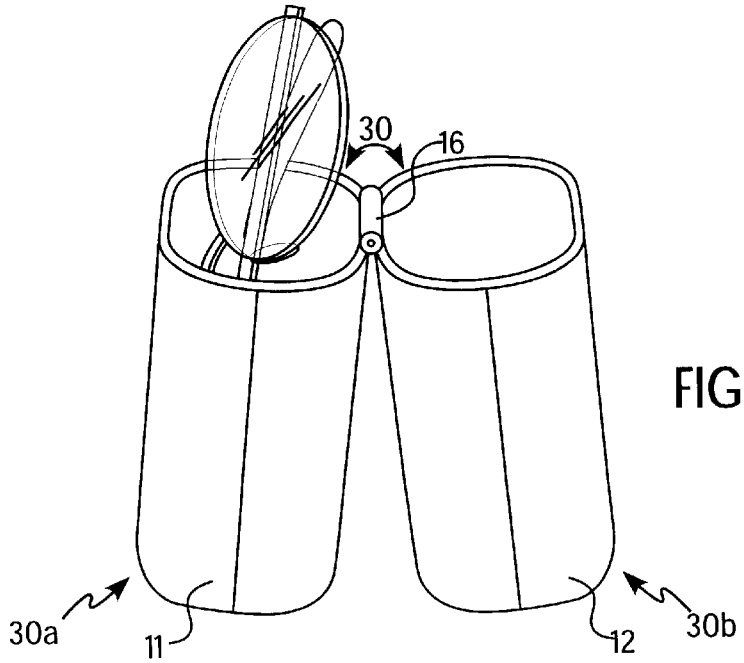
FIG. 2 is a perspective view of the present invention in an eyeglass stand or holder position.

Generally, the present invention provides a storage device having a first container member and second container member being pivotably joined together to form a housing in a closed position or a pair of open housings when pivoted to an open position, and wherein at least one of the container members has a pivotable wall. The invention thereby functions as both an eyeglass case and an eyeglass holder. More particularly, by reference to FIG. 1, eyeglass storage device 10 comprises a first container member 11 and a second container member 12 which are pivotably joined together at a joint location 13 to form a housing 14. Housing 14 defines an area suitable for accommodating a pair of eyeglasses. Alternatively, housing 14 accommodates multiple pairs of eyeglasses. Preferably, container members 11 and 12 are generally equal in size and opposing in relation to each other. By pivotably adjusting first and second container members 11 and 12, housing 14 switches from a closed position 20, where it functions as an eyeglass case, to an open position 30, where it functions as an eyeglass holder or stand as depicted in FIG. 2. Housing 14 may be constructed of any semi-hard material such as, for example, plastic, fiberglass, metal, wood, cardboard, etc. It may also have an outer covering or coverings such as leather, vinyl, material, etc.

At least one of the container members, 11 or 12, has a pivotable wall or lid 15. As shown for example in FIG. 1, first container member 11 has pivotable wall 15. By adjusting this pivotable wall 15, the first container member 12 interchanges from being closed to being open thereby allowing for the insertion or extraction of a pair of eyeglasses from housing 14 when housing 14 is in closed position 20. In this way, the present invention functions, primarily, as an eyeglass storage case. Thus, when the invention is set as an eyeglass storage case, pivoting pivotable wall 15 opens part of the case.

Figure 3:
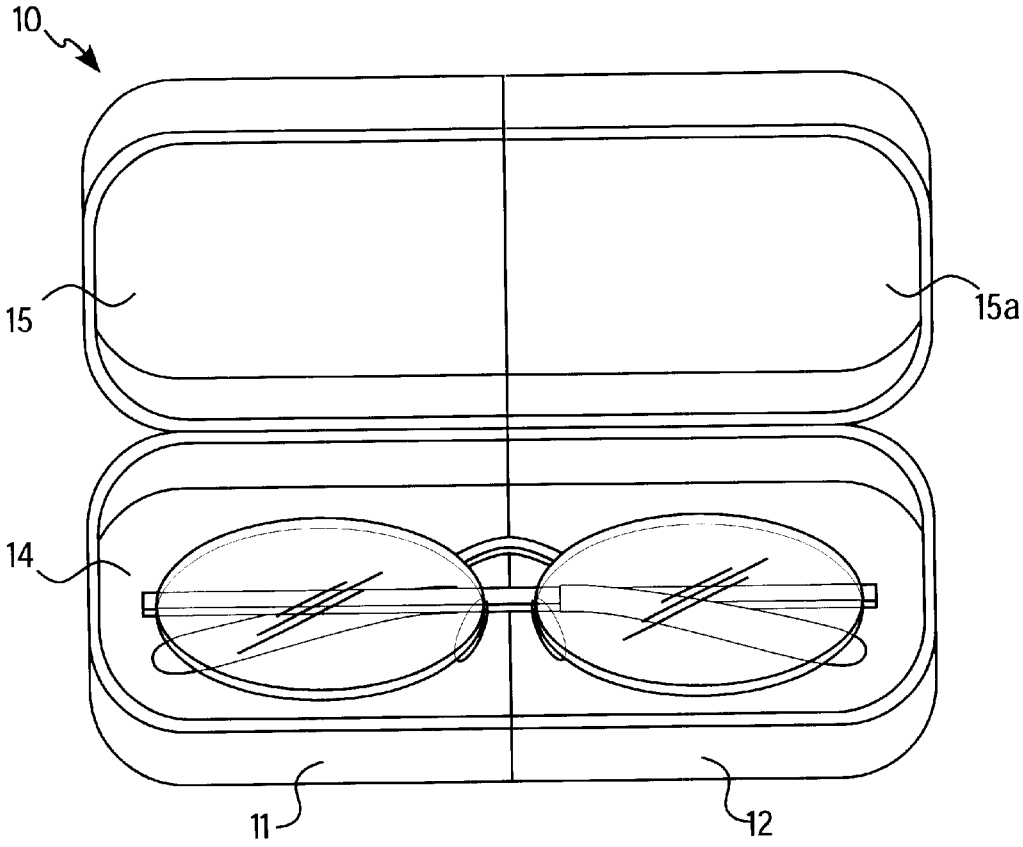
FIG. 3 is a perspective view of the present invention in an eyeglass case storage position that is open.

In a preferred embodiment, the other container member also has a pivotable wall or lid 15. For example, second container member 12 has pivotable wall 15*a* as shown in an open position in FIG. 3. When pivotable walls 15 and 15*a* of first and second container members, 11 and 12, are both open, the invention facilitates a user's access to and from storage device 10 with a pair of eyeglasses.

Figure 4:
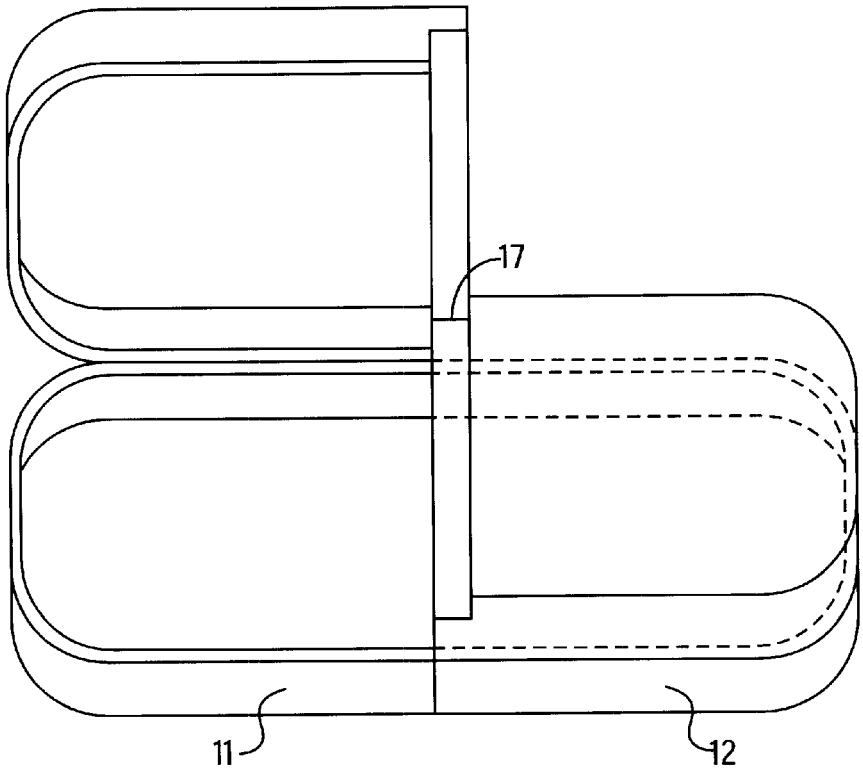
FIG. 4 is a perspective view of the present invention in an eyeglass case storage position wherein pivotable wall overlaps an edge portion of the other container member.
Figure 4A:
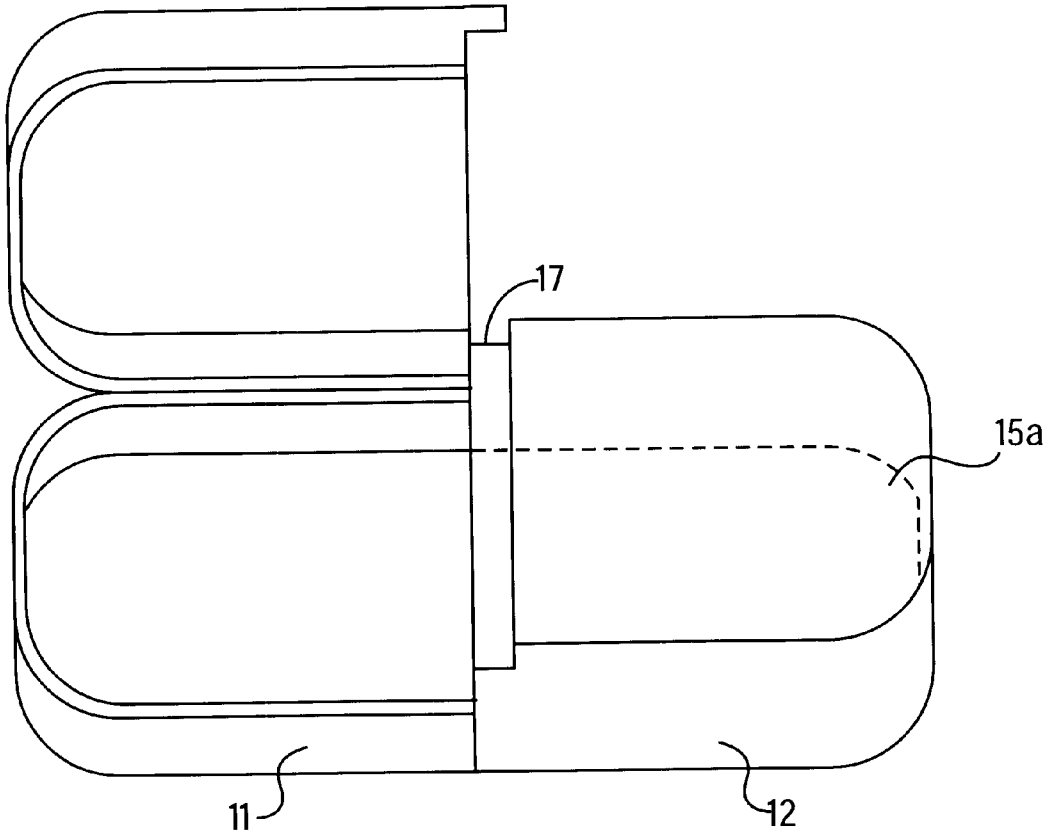
FIG. 4*a* is a perspective view of the present invention in an eyeglass case storage position wherein pivotable wall overlaps an edge portion of a pivotable wall on the other container member.

When housing 14 is in closed position 20 and pivotable wall 15 is also closed, pivotable wall 15 may overlap an edge portion 17 of, or perimeter of the part of the exterior side of, the other container member, as shown in FIG. 4. Preferably, pivotable wall 15 overlaps edge portion 17 of the second container member 12. When second container member 12 has pivotable wall 15*a*, edge portion 17 is designed as a portion of that wall 15*a* as in FIG. 4*a*. Preferably, when pivotable walls 15 and 15*a* are in closed position 20 they rest together so that the exterior surface of first and second container members 11 and 12 is generally flush, although this is not required.

Figure 4B:
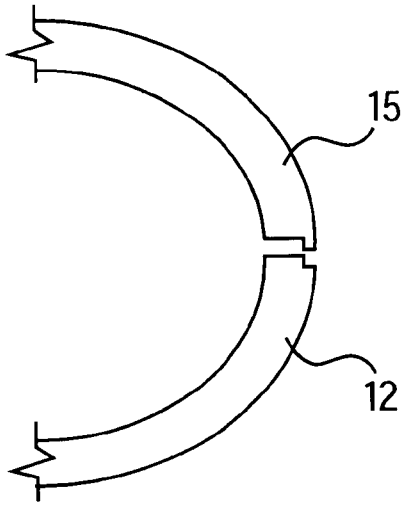
FIG. 4*b* is a cut away view of an example of lid overlap according to an embodiment of the present invention.
Figure 4C:
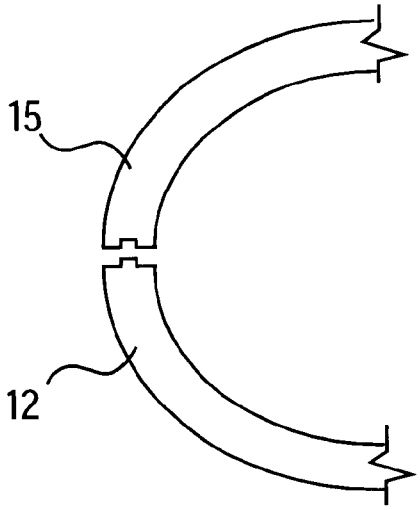
FIG. 4*c* is a cut away view of another example of a view of lid according to an embodiment of the present invention.

There are a variety of ways to accomplish the described overlap. An exploded view of the overlap of a lid with the other container member or another lid is shown, for example, in FIGS. 4*b* and 4*c*. Edge portion 17 is interchangeable between container members or may be incorporated partially into both. Edge portion 17 may comprise multiple edges or grooves in accordance with this invention, depending upon the desired size, thickness and look of the device. Otherwise, a lock device could be used or other connector.

In another embodiment, by reference to FIG. 2, eyeglass storage device 10 comprises a first container member 11 and a second container member 12 which pivotably join together at joint location 13 to form a pair of open housings 30*a* and 30*b*. When housing 14 is in a closed position 20 and the pivotable wall 15 is in an open position (as in FIG. 1), first and second container members 11 and 12 can be manipulated by pivoting, or twisting, them relative to each other, to provide two open housings 30*a* and 30*b* and pivotable wall 15 is returned to closed position (as in FIG. 2). Either or both of open housings 30*a* and 30*b* are suited to hold a pair of eyeglasses. If joint location 13 is at a midpoint on storage device 10 so that first and second container members are of generally equal size then open housings 30*a* and 30*b* will be of generally equal size. However, joint location 13 is not limited to this location and may be located at any place thereon to permit functioning in accordance with the present invention. In this way, the invention switches between being an eyeglass case and an eyeglass holder.

Figure 5:
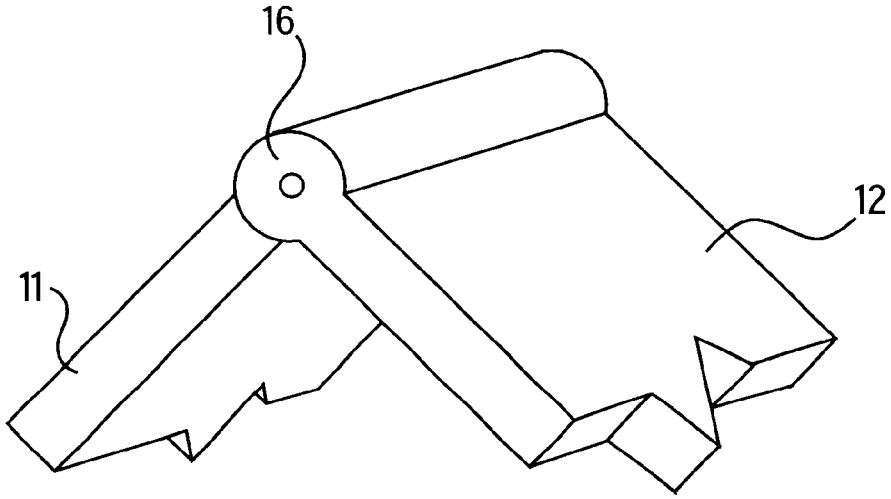
FIG. 5 is an exploded view of an embodiment of the present invention having screw or spring means.

In a preferred embodiment of the present invention a hinge, screw, spring or other pivot means 16, either mechanical or electrical, is provided at joint location 13 to pivotably join together first and second container members 11 and 12, as shown in FIG. 5. For instance, a coil spring means or screw biased hinge 16 may be used to pivotably join container members 11 and 12 and to provide a spring action that both assists the opening or closing of the members and ensures that, when desired, storage device 10 stays in closed position 20. When pivotable wall 15 is designed to and overlaps edge portion 17 of opposing container member 12, pivotable wall 15 prevents the spring or screw biased hinge 16 from spontaneously operating or springing into a stand, or open position 30, until the pivotable wall 15 is open. A catch, lock or snap may also be used to maintain device 10 in either open or closed position. Such may be attached on or along housing 14, at joint location 13, or at another workable place on the device.

Alternatively, a screw biased hinge may be implemented in accordance with the invention. It may include a latch or button release that functions to hold the device 10 in closed storage position 20 until depressed thereby releasing the hinge to move the device 10 into open stand position 30. Depending upon implementation in this way, pivotable wall or lid 15 may or may not need to have been in previously opened position, as means 16 can optionally be installed to also trigger that function.

While the foregoing describes the various elements, the constructions thereof and dimensions of the present invention, the description is illustrative and not to be considered as limiting any features of the invention. It is also to be understood that the following claims are intended to cover generic and specific features of the invention.

What is claimed is:

1. An eyeglass storage device comprising a first and second container member said container members being pivotally joined together to form a housing in a closed position dimensioned to accommodate and enclose a pair of eyeglasses and to form a pair of open housings when pivoted to an open position such that said pair of open housings provides a stand for holding eyeglasses, each of said open housings being a holder for a pair of eyeglasses, at least one of said container members having a pivotable wall portion.

2. An eyeglass storage device as set forth in claim 1 wherein said second container member includes said pivotable wall portion.

3. An eyeglass storage device as set forth in claim 1 wherein said first and second container members are pivotally joined together using a hinge, screw, spring or other pivot means.

4. An eyeglass storage device as set forth in claim 2 wherein said pivotable wall portion has at least one edge portion designed to accommodate or movably connect with a part of said first container member.

5. An eyeglass storage device as set forth in claim 2 wherein said first container member also includes said pivotable wall portion, said portion being adjacent to said pivotable wall portion of said second container member.

6. An eyeglass storage device as set forth in claim 1 wherein said first container member essentially comprises a single unit.

7. An eyeglass storage device as set forth in claim 4 wherein said first container member includes an indented edge designed to accommodate the edge portion of said pivotable wall portion.

8. An eyeglass storage device as set forth in claim 2 wherein said pivotable wall portion adjusts to open or close said second container member thereby allowing for the insertion or extraction of a pair of eyeglasses from said device.

9. An eyeglass storage device as set forth in claim 1 wherein said first and second container members are of substantially similar dimension such that said members are generally flush with each other when pivotally joined together.

10. An eyeglass storage device as set forth in claim 1 further including at least one opening means on said first container member, said second container member or both container members for releasing and securing said members at said pivotal joinder, wherein said means is selected from one or more of the group consisting of a catch, lock, snap, latch and button.

* * * * *